US011173683B2

(12) United States Patent
Trento et al.

(10) Patent No.: US 11,173,683 B2
(45) Date of Patent: Nov. 16, 2021

(54) APPARATUS AND METHOD FOR FORMING BOXES WITH CURVED CORNERS FROM A DIECUT SHEET

(71) Applicant: GEO PROJECT INDUSTRIES S.R.L., Padua (IT)

(72) Inventors: Maurizio Trento, Padua (IT); Gianluca Lovisetto, Padua (IT)

(73) Assignee: GEO PROJECT INDUSTRIES S.R.L., Padua (IT)

( * ) Notice: Subject to any disclaimer, the term of this patent is extended or adjusted under 35 U.S.C. 154(b) by 228 days.

(21) Appl. No.: 16/443,490

(22) Filed: Jun. 17, 2019

(65) Prior Publication Data

US 2020/0047445 A1 Feb. 13, 2020

(30) Foreign Application Priority Data

Jun. 18, 2018 (IT) ..... 102018000006419

(51) Int. Cl.

| | |
|---|---|
| ***B31B 50/73*** | (2017.01) |
| ***B65D 5/02*** | (2006.01) |
| ***B31B 50/86*** | (2017.01) |
| ***B31B 50/46*** | (2017.01) |

(52) U.S. Cl.

CPC ..... *B31B 50/734* (2017.08); *B31B 50/46* (2017.08); *B31B 50/86* (2017.08); *B65D 5/0209* (2013.01)

(58) Field of Classification Search

CPC . B31B 50/734; B31B 5/0209; B31B 2110/20; B31B 2100/0028; B31B 2110/30; B31B 2110/40; B31B 2120/10; B31B 50/86; B31B 50/46; B31B 50/003; B31B 50/07; B31B 50/12; B31B 50/28;

(Continued)

(56) References Cited

U.S. PATENT DOCUMENTS 2,925,758 A * 2/1960 Beetz ..... B21D 51/2646 493/136
2,929,302 A * 3/1960 Brown ..... B31B 50/00 493/137

(Continued)

OTHER PUBLICATIONS

Italian Search Report for corresponding Italian Patent Application No. 102018000006419 dated Mar. 6, 2019, 7 pages.

*Primary Examiner* — Thanh K Truong
*Assistant Examiner* — Katie L Gerth
(74) *Attorney, Agent, or Firm* — Merchant & Gould P.C.

(57) ABSTRACT

An apparatus forms boxes with curved corners from a die-cut sheet. A forming matrix delimits a forming cavity by guides counterposed in pairs along two orthogonal axes. The guides define a die-cut sheet support plane. A forming head inserts inside the cavity to push the die-cut sheet to form a box. Vacuum gripping devices are arranged outside the cavity in opposite positions along the second axis and each grip from underneath the die-cut sheet to hold it on the support. Pusher devices are arranged outside and near one of the corners of the cavity. Each pusher device raises one side flap of the die-cut sheet from the support plane. An electronic control unit operates the main gripping devices, pusher devices and forming head according to the following sequence: actuating the gripping devices; actuating the pushers; deactivating the gripping devices; and inserting the forming head in the forming cavity.

21 Claims, 17 Drawing Sheets

(58) Field of Classification Search
CPC ..... B31B 50/44; B31B 50/592; B65B 43/54; B65B 47/06
USPC ..... 493/137, 167–174
See application file for complete search history.

(56) References Cited

U.S. PATENT DOCUMENTS 3,008,386 A * 11/1961 Name not available ..... B31B 50/00 493/126
3,101,653 A * 8/1963 Burden ..... B31B 50/00 493/140
3,191,508 A * 6/1965 Beamish ..... B31B 50/00 493/116
3,260,174 A * 7/1966 Pierce, Jr. ..... B31B 50/00 493/167
3,511,138 A * 5/1970 Baker ..... B31B 50/00 493/34
3,513,757 A * 5/1970 Frank ..... B65H 1/06 493/131
3,521,530 A * 7/1970 Pierce, Jr. ..... B31B 50/00 493/137
3,626,819 A * 12/1971 Hoyrup ..... B31B 50/00 493/132
3,635,129 A * 1/1972 Cobelo, Jr. ..... B31B 50/00 493/6
3,747,480 A * 7/1973 Kalikow ..... B31B 50/00 493/125
3,800,681 A * 4/1974 Corderoy ..... B31B 70/00 493/167
4,028,999 A * 6/1977 Lee ..... B31B 50/00 493/126
4,052,933 A * 10/1977 Royal ..... B65D 5/003 493/171
4,256,025 A * 3/1981 Goda ..... B31B 50/00 493/160
4,283,188 A * 8/1981 Wingerter ..... B31B 50/00 493/120
4,522,618 A * 6/1985 Stannard ..... B31B 50/00 493/130
4,674,998 A * 6/1987 Benedicenti ..... B31B 50/00 493/164
5,059,165 A * 10/1991 Wallin ..... B31B 50/00 493/137
5,156,583 A * 10/1992 Baas ..... B31B 50/00 493/140
5,178,600 A * 1/1993 Harder ..... B31B 70/00 493/162
5,228,934 A * 7/1993 Weder ..... A47G 7/085 156/227
5,286,247 A * 2/1994 Weder ..... A01G 9/02 493/133
5,523,046 A * 6/1996 Weder ..... A01G 9/02 156/277
5,632,713 A * 5/1997 Canning ..... B31B 70/00 493/137
5,795,281 A * 8/1998 Weder ..... B31B 70/00 493/154
5,985,187 A * 11/1999 Weder ..... B29C 51/082 264/40.1
6,312,369 B1 * 11/2001 Plemons ..... B65D 11/1893 493/136
7,445,589 B2 * 11/2008 Jaen ..... B31B 50/00 493/167
8,105,223 B2 * 1/2012 Graham ..... B65D 5/4608 493/127
2005/0137072 A1 * 6/2005 Jackson ..... 493/171
2014/0073497 A1 * 3/2014 Mack ..... B31B 50/44 493/151
2014/0113787 A1 * 4/2014 Aganovic ..... B31B 50/00 493/122
2015/0175293 A1 * 6/2015 Jacomelli ..... B65D 5/0209 229/109
2015/0191274 A1 * 7/2015 Linares ..... B26D 1/385 493/405
2015/0290897 A1 * 10/2015 Le Monnier ..... B31F 5/00 493/91
2017/0313465 A1 * 11/2017 Vistrom ..... B31B 50/786
2017/0361559 A1 * 12/2017 Crackett ..... B31B 50/46

* cited by examiner

APPARATUS AND METHOD FOR FORMING BOXES WITH CURVED CORNERS FROM A DIECUT SHEET

This application claims benefit of Serial No. 102018000006419, filed 18 Jun. 2018 in Italy and which application is incorporated herein by reference. To the extent appropriate, a claim of priority is made to the above-disclosed application.

FIELD OF APPLICATION

The object of the present invention is an apparatus and a method for forming boxes with curved corners from a die-cut sheet.

In general, "box with curved corners" means a box-like container, which has a square or rectangular plan section, with curved or rounded corners and is made from a single sheet suitably die-cut, usually made of cardboard. Generally, the box is provided with an opening top wall, also part of the starting die-cut sheet.

Advantageously, the apparatus and method for forming boxes according to the invention can also be used to form boxes with sharp-edged corners, always starting from a die-cut sheet.

PRIOR ART

Boxes with curved corners are widely used in the packaging sector. The construction of a box with curved corners is more complex than similar cases having a sectional plan with sharp corners. The presence in the die-cut sheet of the curved corners, in fact, modifies the behavior of the die-cut sheet during its folding, imposing operating steps that are not necessary in the creation of a box with sharp-edged corners.

In general, a box with curved corners B, illustrated for example in FIGS. 1*b* and 1*c*, comprises a base F1, two front side walls F2 and F3 (opposite each other), two head walls F5 and F6 and, preferably, a top/cover F4. The plan section with curved corners is obtained by rounding the corners of the base F1 and the top F4 (if provided) and appropriately curving the two head walls F5 and F6 which connect the two front side walls F2 and F3 to each other.

More in detail, as shown in FIG. 1*a*, the starting die-cut sheet F to form a box with curved corners comprises four main portions F1, F2, F3 and F4 mutually separated by pre-folding lines L. In the finished box, such main portions respectively define the base F1 of the box, the two front side walls F2 and F3 and the top F4. These four main portions are connected together in succession along a main axis X of the die-cut sheet. The two side walls F2 and F3 are connected on two opposite sides of the base F1, while the top F4 is connected to one of the two side walls F3.

The starting die-cut sheet includes four side flaps G1', G1 "and G2', G2", which are intended to define in pairs the two head walls F5 and F6 and extend laterally from the portions of the sheet, which define the two side walls F2 and F3. The starting die-cut sheet also includes four fastening tabs G3', G3" and G4', G4", which overlap partially on the side flaps G1', G1" and G2', G2" when the box is finished, connecting them together (by bonding) two by two. These fastening tabs extend laterally from the portions of the sheet defining the base F1 and the top F4.

In order to be able to follow the round shape at the corners of the box that connect the side walls and the top walls to each other, in the junction area between the side walls F2 and F3 and the four side tabs G1', G1" and G2', G2" no pre-folding lines are provided or, if provided, they are not very marked. The absence or weakness of the pre-folding lines means that, when raised with respect to the side walls F2 and F3, the side flaps G1', G1" and G2', G2" tend to return on the plane of the side wall from which they extend. This behavior, if not opposed, would lead the side flaps to open outwards, ruining the construction of the box. For this reason it is essential that the fastening tabs G3', G3" extending from the base F1 are positioned outside with respect to the side flaps, so as to counteract the opening and hold them in position, from the earliest stages of the formation of the box. This requires an effective control of the mutual positioning of the side flaps and the fastening tabs during the formation of the box.

The need to implement this control excludes the possibility of forming boxes with curved corners using traditional presser forming machines used instead to form boxes with sharp corners.

As is known, a presser forming machine comprises a forming cavity and a presser element which can be inserted inside the cavity and has a shape corresponding to the cavity itself. The cavity has a plan section substantially corresponding to the shape of the base of the box and a height at least equal to the height of the finished box. Operatively, the die-cut sheet is positioned above the cavity in such a way that the portion corresponding to the base is arranged at the cavity and the other portions of the sheet are arranged externally thereto, resting on suitable recess elements. After the die-cut sheet has been so positioned, the base portion of the sheet is pushed into the cavity by the presser element. Going down inside the cavity, the base drags therewith the other portions of the sheet, which—forced by the presser element against the side walls of the cavity—assume the shape of the cavity itself. The operations of folding the die-cut sheet take place substantially simultaneously, to the advantage of the rapidity of execution of the process. This is made possible by the fact that the side flaps (connected to the die-cut sheet by means of normal pre-folding lines) do not have the tendency to oppose folding, i.e. they have a predictable and uniform behavior, which does not need to be controlled.

Otherwise, as already mentioned, the manufacture of a box with curved corners requires an accurate control of the positioning of the side flaps, which cannot be obtained with the presser forming machines described above.

For this reason, to date the boxes with curved corners are made only with wrap around devices, that is to say, which make the box by shaping (wrapping) the die-cut sheet directly around the product.

The wrap around devices sequentially separate the various folding steps and are operationally more flexible. Therefore, they allow implementing a control of the positioning also of the side flaps, essential for making a box with curved corners.

Compared to the presser forming machines described above, the wrap around devices are, however, constructively more complex and expensive. Finally, due to the separation of the folding steps, they require an extension of the production times.

There is therefore in the packaging sector the need to form boxes with curved corners starting from a die-cut sheet combining the high quality of construction permitted by the wrap-around technology with the simplicity and operating speed of presser forming machines.

DISCLOSURE OF THE INVENTION

Therefore, the object of the present invention is to eliminate all or part of the drawbacks of the aforementioned prior art by providing an apparatus and a method for forming boxes with curved corners starting from a die-cut sheet, which combines high quality of manufacture allowed by the wrap-around technology with the simplicity and operational speed of the presser forming machines.

A further object of the present invention is to provide an apparatus for forming boxes with curved corners starting from a die-cut sheet, which can be easily managed from an operational point of view.

A further object of the present invention is to provide an apparatus for forming boxes with curved corners starting from a die-cut sheet, which is simple and cost-effective to make.

BRIEF DESCRIPTION OF THE DRAWINGS

The technical features of the invention, according to the aforesaid aims, can clearly be seen in the content of the claims below, and its advantages will become more readily apparent in the detailed description that follows, made with reference to the accompanying drawings, which illustrate one or more purely exemplary and non-limiting embodiments thereof, in which:

DETAILED DESCRIPTION

Figure 1B:
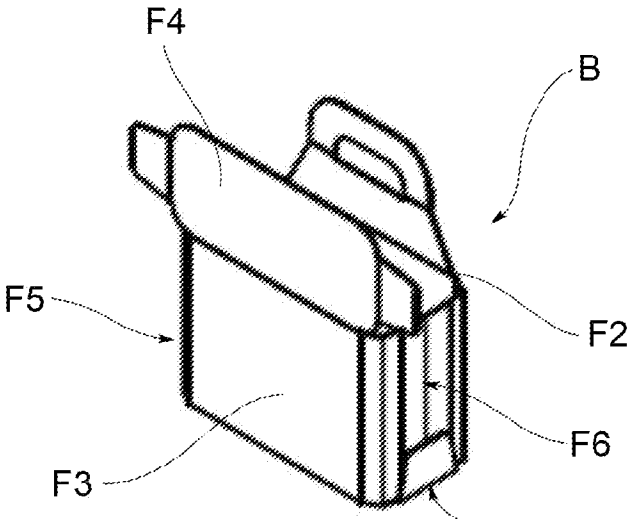
FIG. 1*b* shows a partially finished box obtained by folding the die-cut sheet of FIG. 1*a;*

With reference to the accompanying drawings, an apparatus for forming boxes with curved corners starting from a die-cut sheet according to the invention has been indicated as a whole with reference numeral 1.

In particular, the die-cut sheet is made of paper, or light cardboard.

For simplicity of description, the method according to the invention will be described after the apparatus 1, referring in particular to the latter.

Herein and in the following description and in the claims, reference will be made to the apparatus 1 in the condition of use. Therefore, any references to a lower or upper position or to a horizontal or vertical orientation should be interpreted in such condition.

The apparatus 1 for forming boxes with curved corners starting from a die-cut sheet according to the invention is generally able to form boxes with curved corners, separately from the products which must then be arranged therein. The boxes with curved corners made with the apparatus according to the invention can be destined to the packaging of any product, for example already packaged, for example in bottles (wine, beer, etc.) or in sachets (food products, pet-food) or bulk products, such as sweets, chocolates, etc.

As will be clarified in the following description, the forming apparatus 1 according to the invention allows effecting an effective control of the mutual positioning of the side flaps and of the fastening tabs during the formation of the box.

Advantageously, the forming apparatus 1 can also be used to form boxes with sharp-edged corners, in the case in which, similarly to the case of boxes with curved corners, it is necessary to ensure a precise and constant reciprocal positioning between the side flaps and the fastening tabs.

The apparatus 1 according to the invention is intended to treat a die-cut sheet F (illustrated for example in FIGS. 1*a*, 1*b* and 1*c*) comprising:

- at least three main portions F1, F2, F3, which define respectively a base F1 and two opposite front side walls F2 and F3 of a single box B and are connected to each other successively along a main axis X of the die-cut sheet by pre-folding lines L, with the two side walls F2 and F3 connected in opposite positions to the base F1 and the top F4 connected to one of the two side walls F3;
- four side flaps G1', G1" and G2', G2", which define in pairs two head walls F5 and F6 of the box and extend laterally from the two side walls F2 and F3; and
- at least two fastening tabs (G3', G3"), which extend laterally from the base (F1) via pre-folding lines (L) and are designed to overlap at least partially with the side flaps G1', G1 'and G2', G2" connecting them in pairs.

Figure 1A:
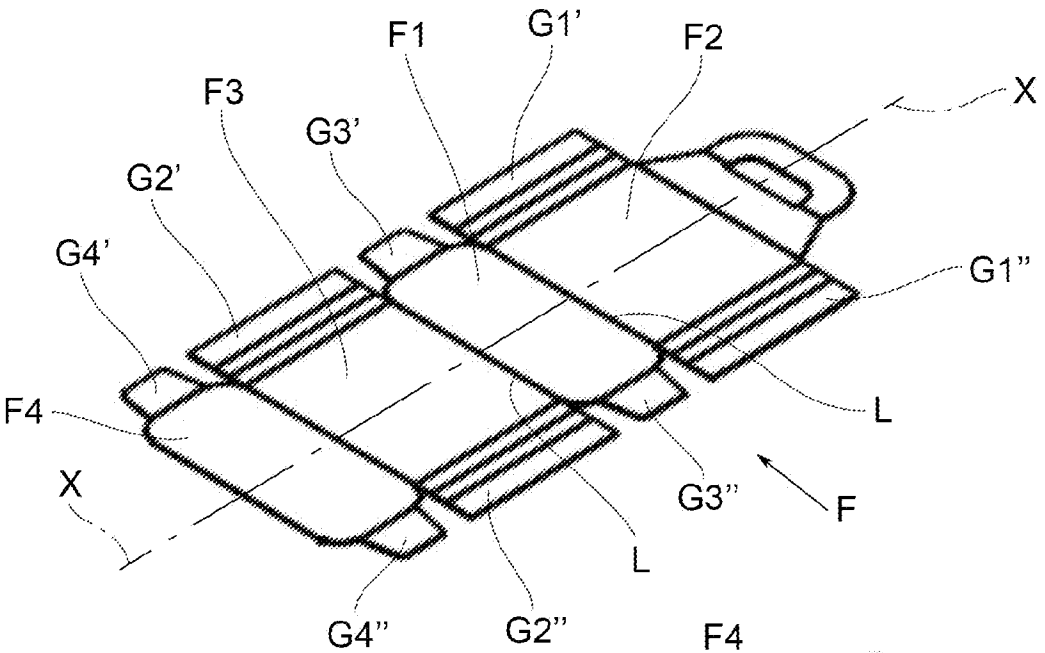
FIG. 1*a* shows a perspective view of an example of a die-cut sheet for making a box with curved corners.
Figure 1C:
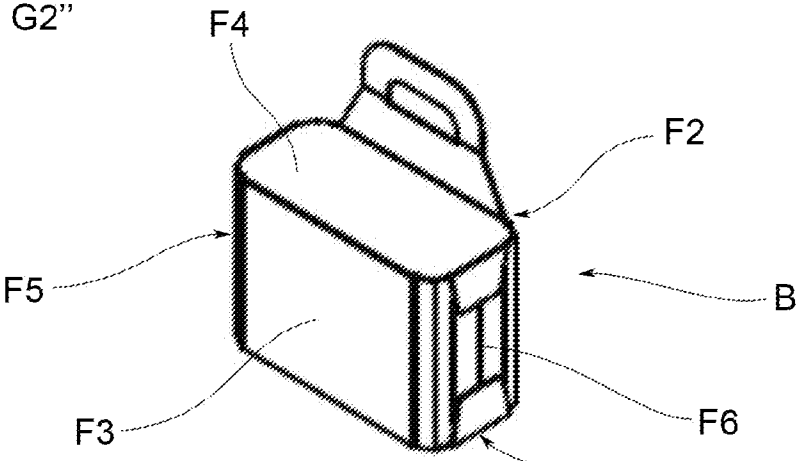
FIG. 1*c* shows the box shown in FIG. 1*b* completed.
Figure 2:
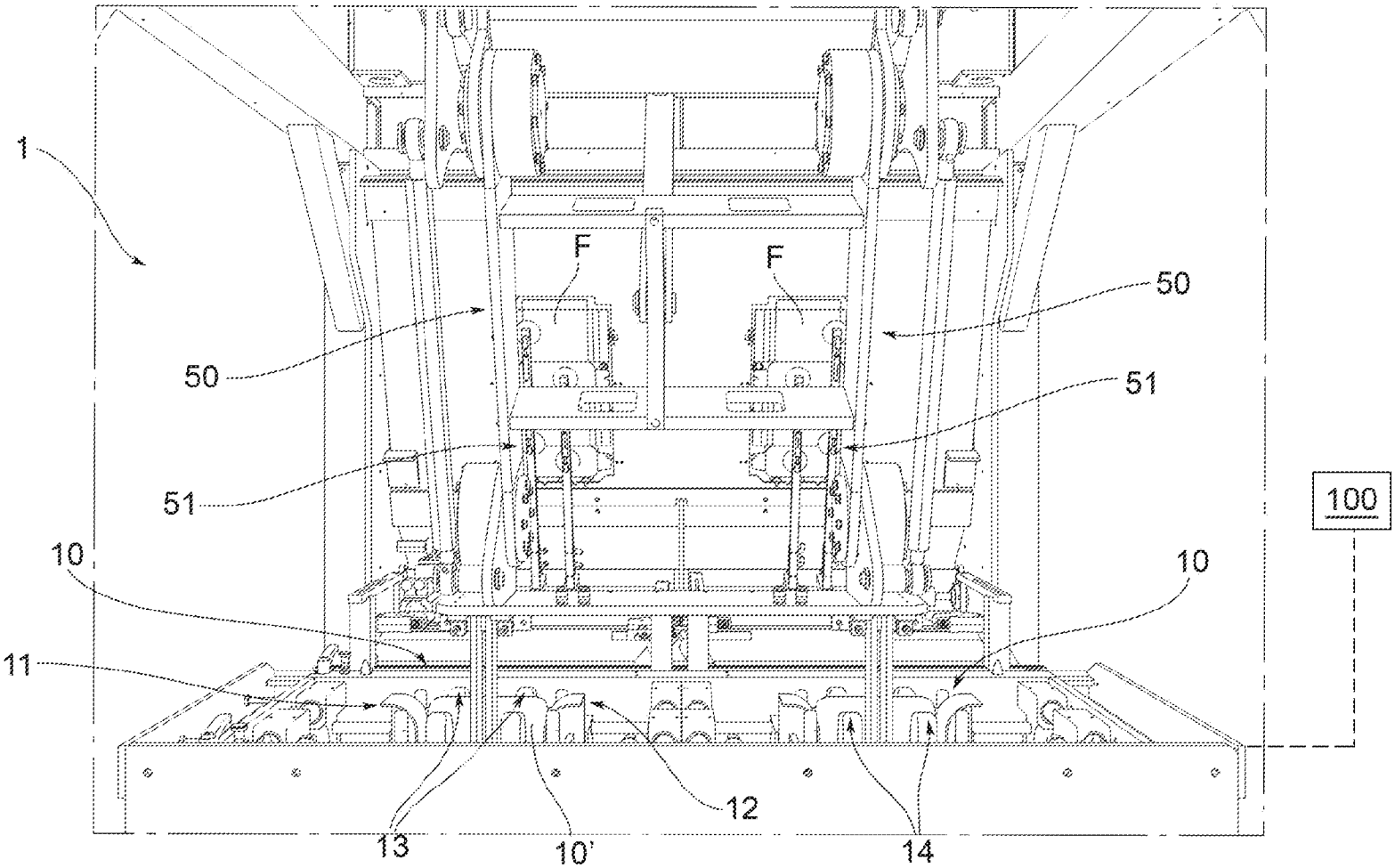
FIGS. 2 to 11 show in sequence the operating steps of an apparatus for forming boxes with curved corners starting from a die-cut sheet according to an embodiment of the present invention.
Figure 3:
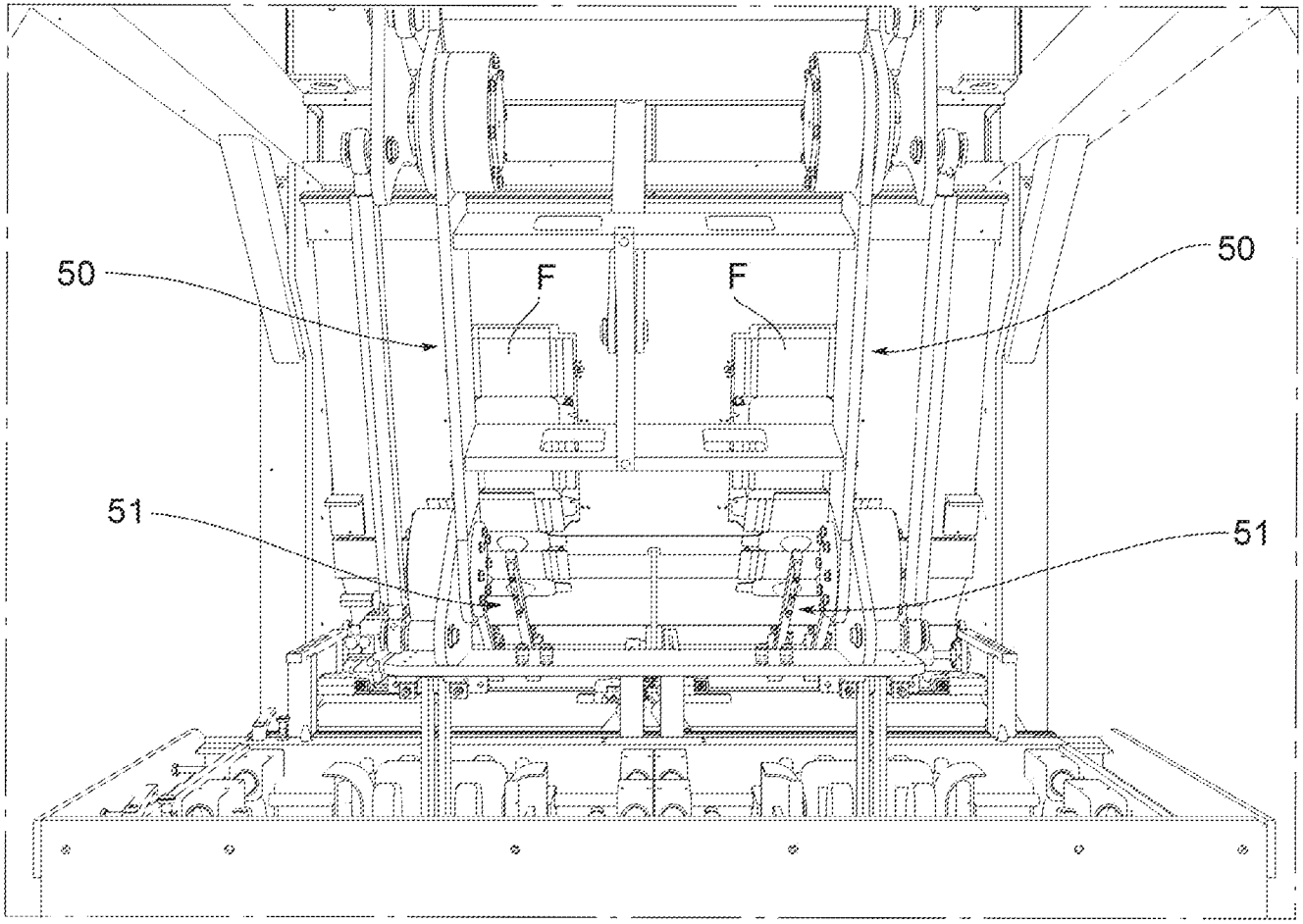
Figure 4:
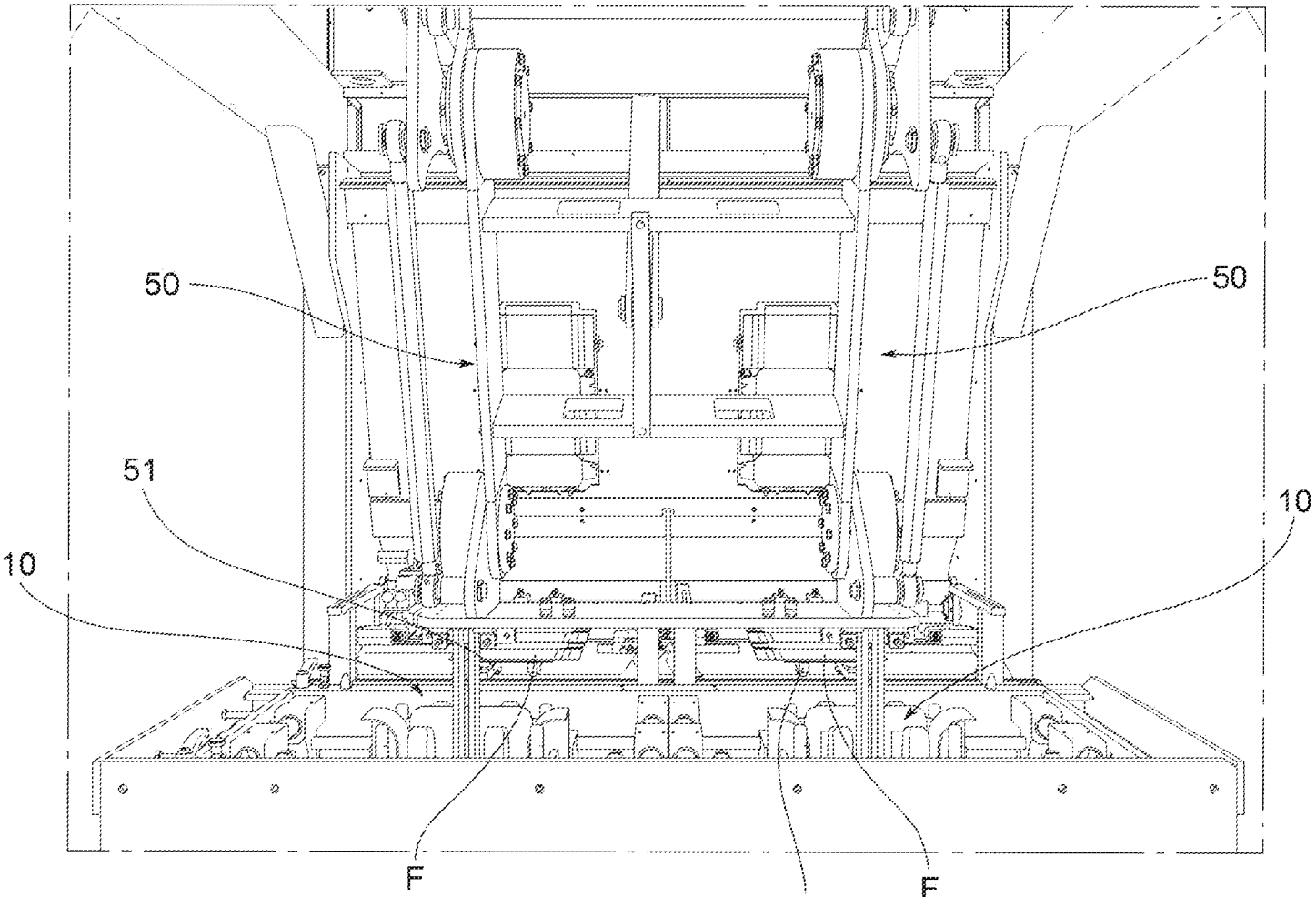
Figure 5:
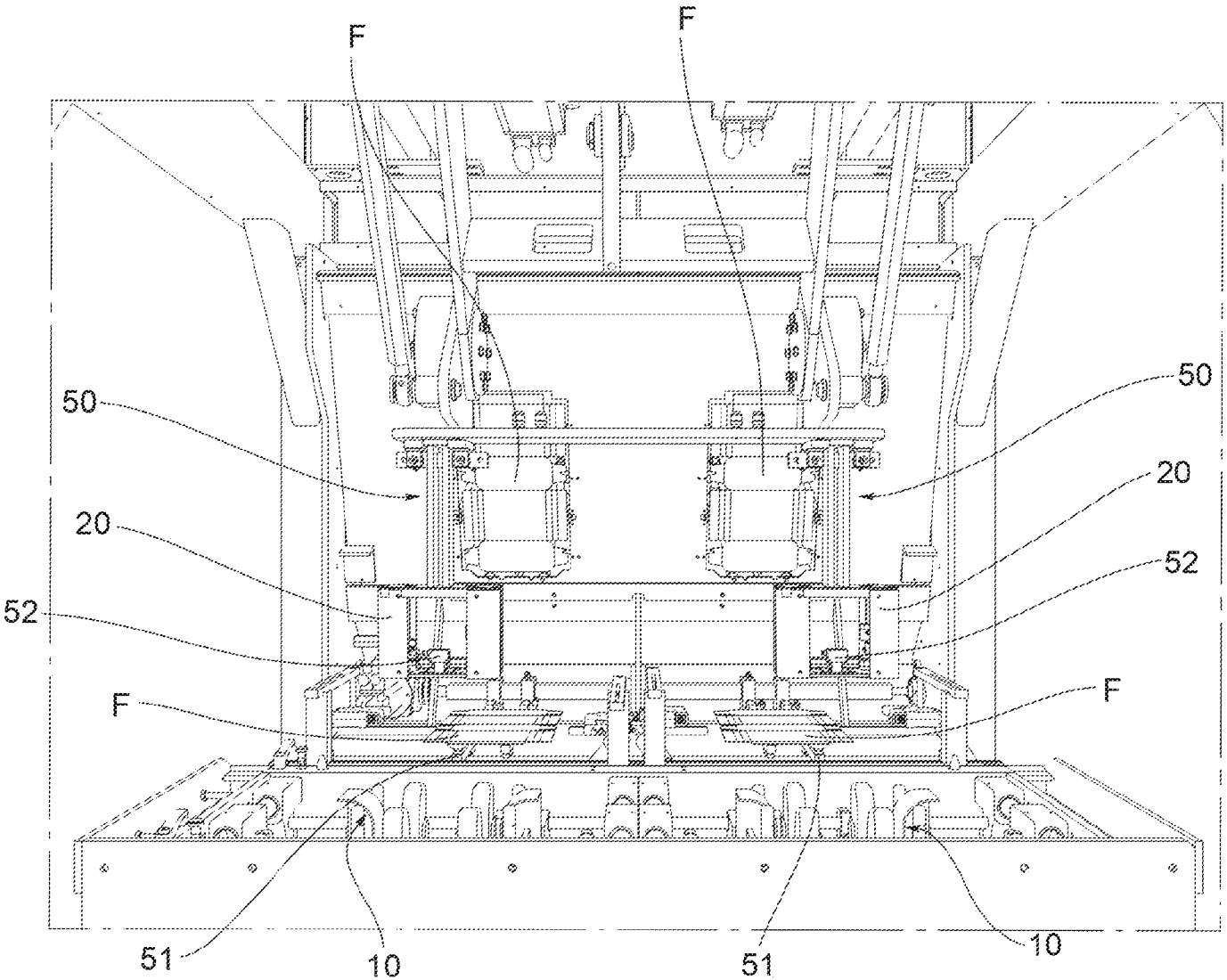
Figure 6:
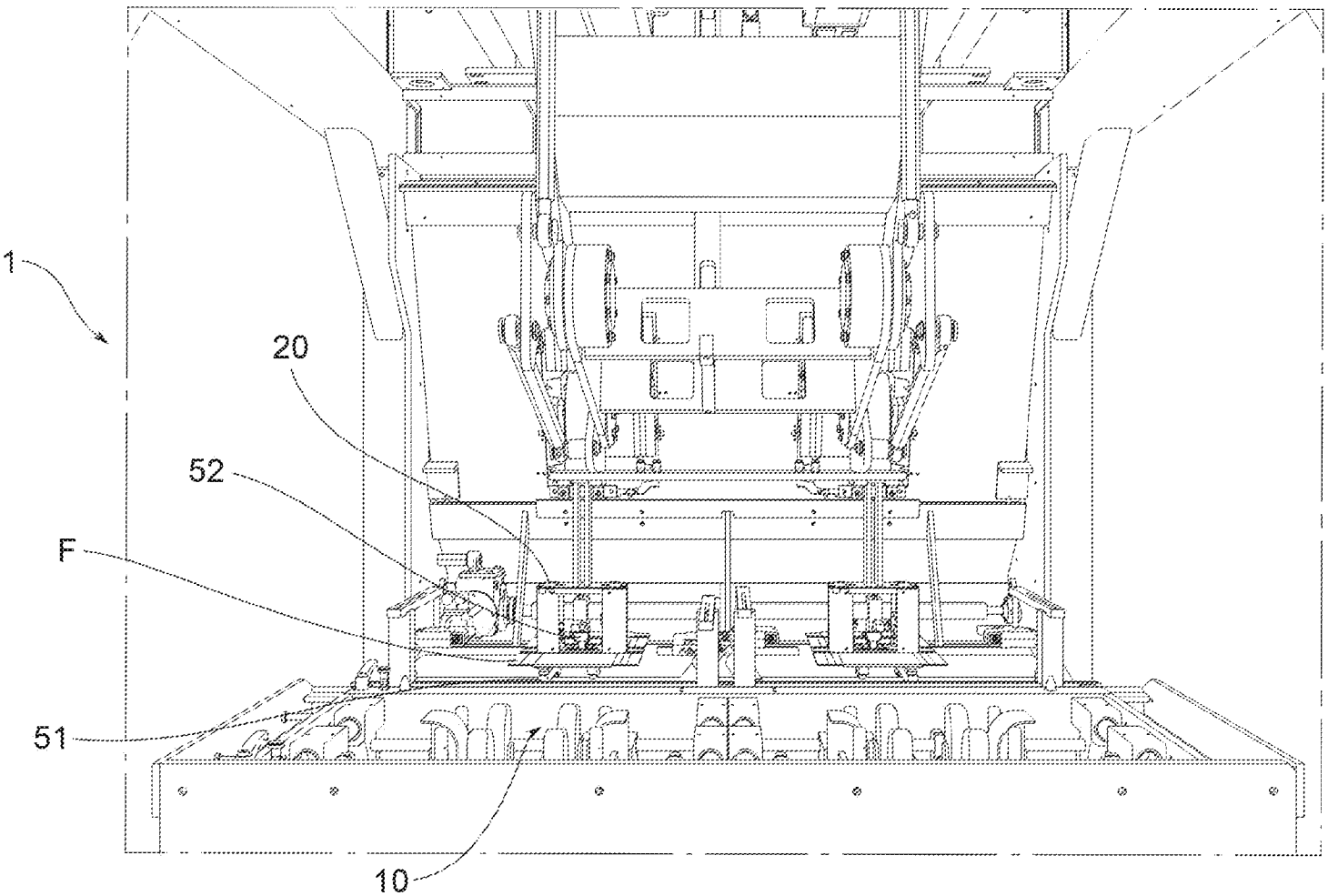
Figure 7:
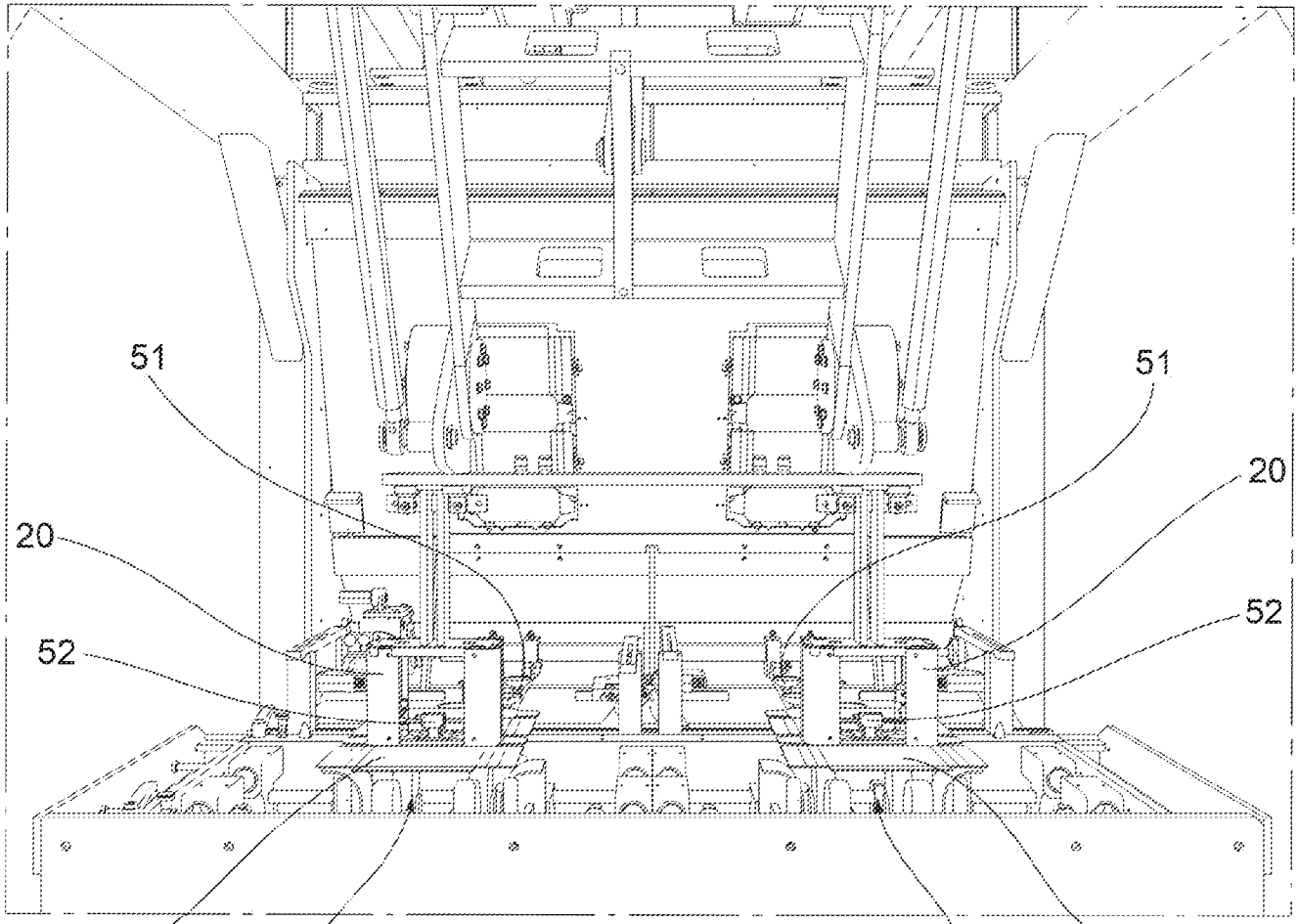

As shown in FIGS. 1*a*, 1*b* and 1*c*, the die-cut sheet F may comprise a fourth main portion F4, which defines the top (or cover) of the individual box B. This fourth portion F4 is connected to one of the two side walls F3 by means of a pre-folding line. Preferably, also from this fourth main portion F4 two fastening tabs (G4', G4") extend laterally, which are intended to overlap at least partially the side flaps G1', G1" and G2', G2" connecting them to each other in pairs, in the opposite position with respect to the two fastening tabs G3', G3" which extend from the base F1.

The shape just described of the die-cut sheet F is the same whether it is a box with curved corners or a box with sharp corners. The only difference is that in the die-cut sheets F for cases with curved corners in the junction area between the side walls F2 and F3 and the four side tabs G1', G1" and G2', G2" no pre-folding lines are provided or, if provided, they are not very marked. This is done in order to be able to follow the round shape at the corners of the box that connect the side walls and the top walls to each other.

On the contrary, normal pre-folding lines are provided in die-cut sheets F for boxes with sharp corners in the junction area between the side walls F2 and F3 and the four side flaps G1', G1" and G2', G2".

The similarity of the two types of die-cut sheets means that the apparatus and the forming method 1 according to the invention may also be used to form boxes with sharp-edged corners.

According to a general embodiment of the invention illustrated in the accompanying figures, the forming apparatus 1 comprises at least one forming matrix 10, which delimits a forming cavity 10' by means of two pairs of guides 11, 12 and 13, 14 which are counterposed in pairs along two orthogonal axes Y1 and Y2 of the above cavity 10'.

Figure 15:
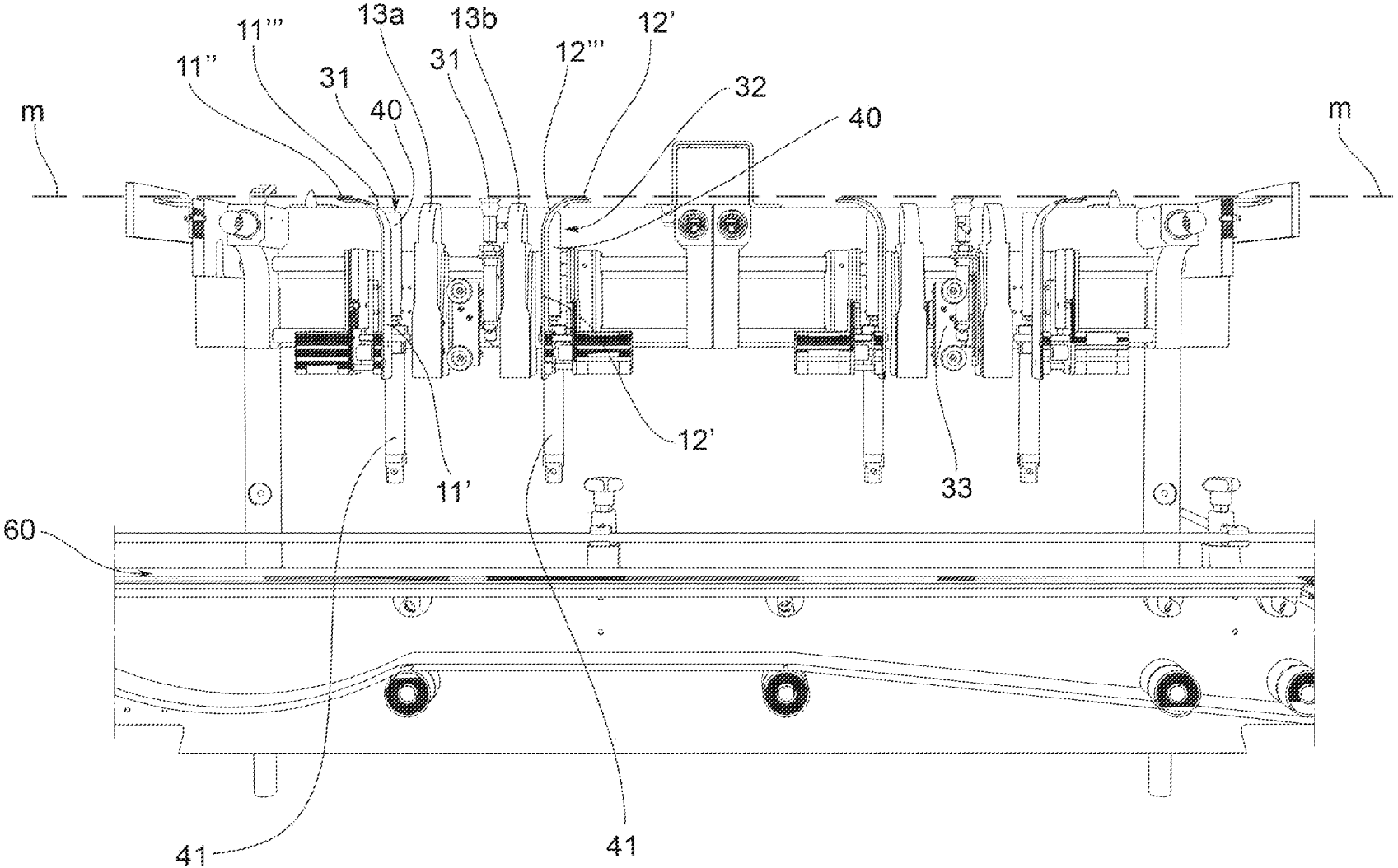
FIG. 15 shows a sectional (slightly perspective) view of the forming matrix shown in FIG. 12, according to the section plane XV-XV indicated therein.
Figure 16:
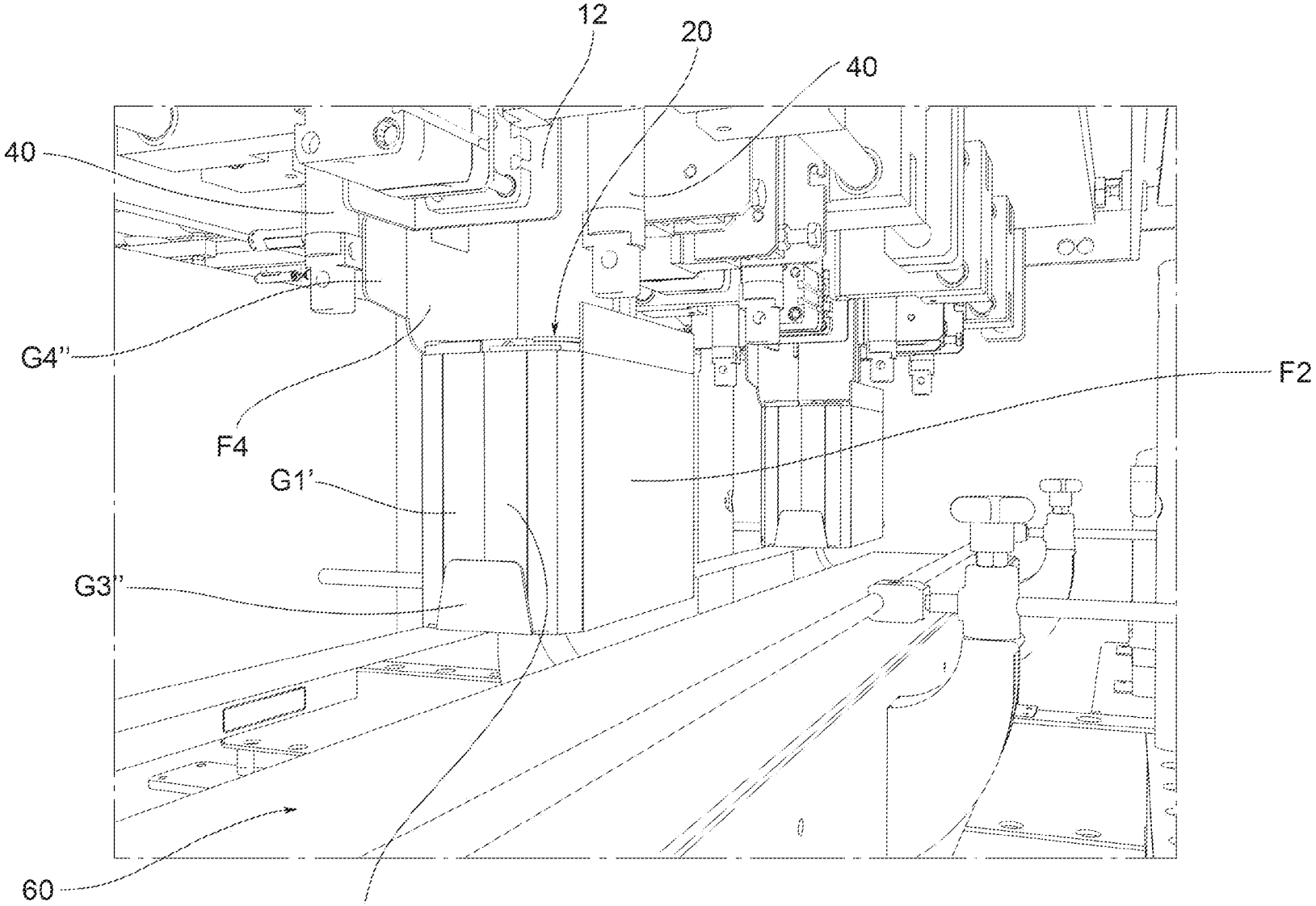
FIG. 16 shows a perspective view from below of the forming matrix, illustrated with the already formed box still present.

As schematically shown in FIG. 15, such guides 11, 12 and 13, 14 define with their top a support plane m for said die-cut sheet F.

The forming apparatus 1 further comprises a forming head 20, which in use (see in particular FIGS. 8, 9 and 10) can be inserted inside the aforesaid forming cavity 10' to push into the cavity itself the die-cut sheet F lying on the support plane m, so as to form a box B by folding the die-cut sheet itself.

Figure 8:
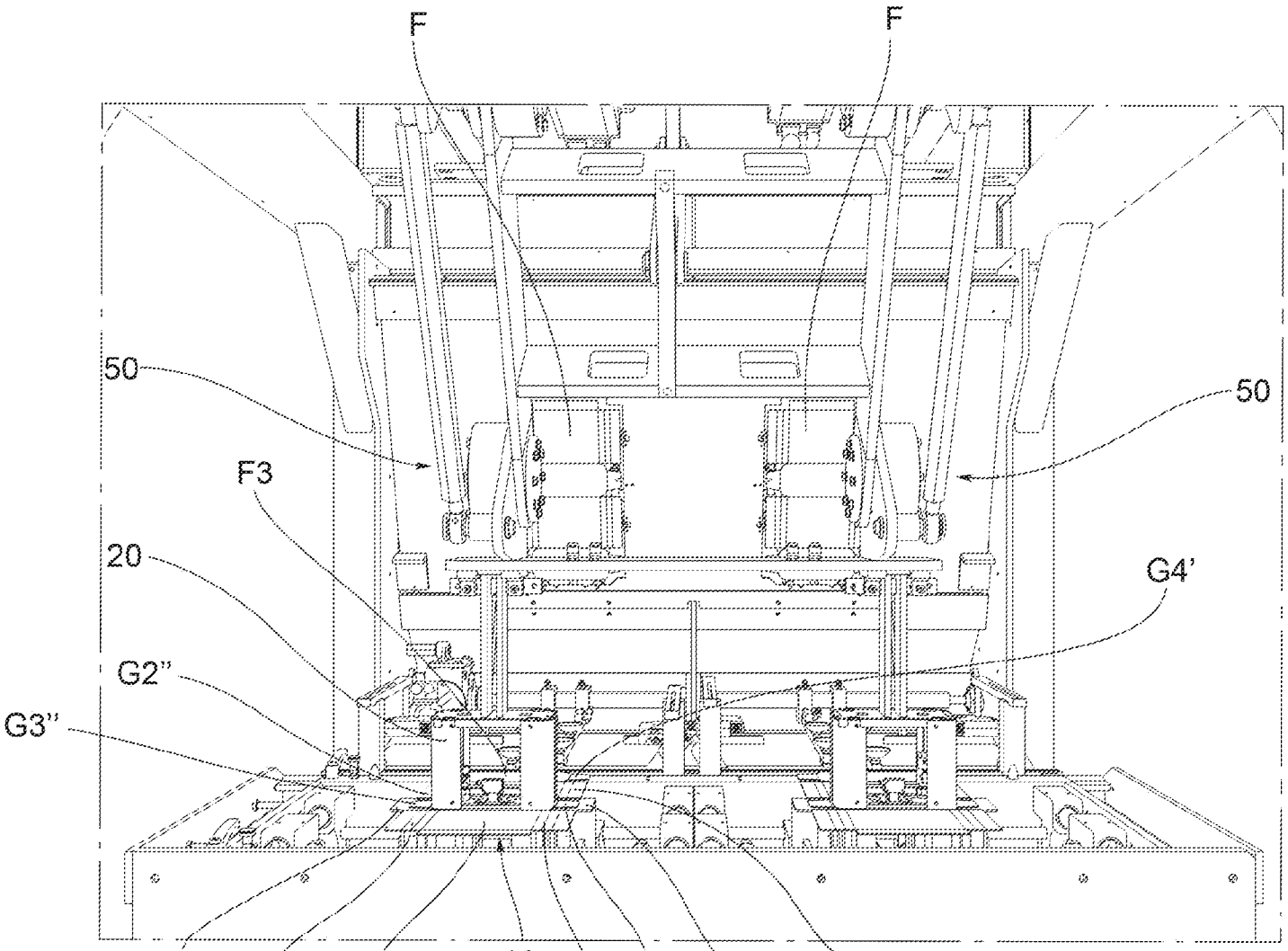
Figure 17:
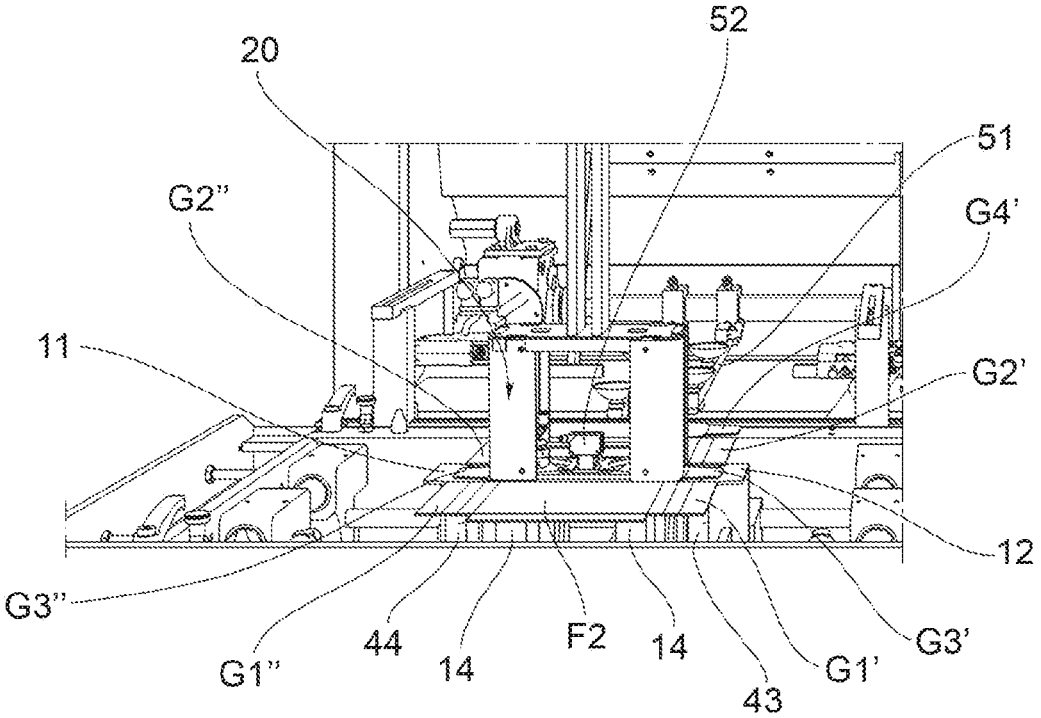
FIGS. 17 and 18 respectively show an enlarged detail of FIGS. 8 and 9.

Operatively, as can be seen in FIGS. 8 and 17, the forming matrix 10 is intended to receive the die-cut sheet F resting on said support plane m so that:

- the base F1 of the die-cut sheet F is arranged directly above the forming cavity 10' with its two fastening tabs G3', G3" positioned over a first pair of guides 11, 12, wherein the guides of such first pair are opposite each other along a first axis Y1 of the cavity; and
- the two side walls F2, F3 are arranged above the second pair of guides 13, 14, wherein the guides of such a second pair are opposite along a second axis Y2 of the cavity.

Figure 12:
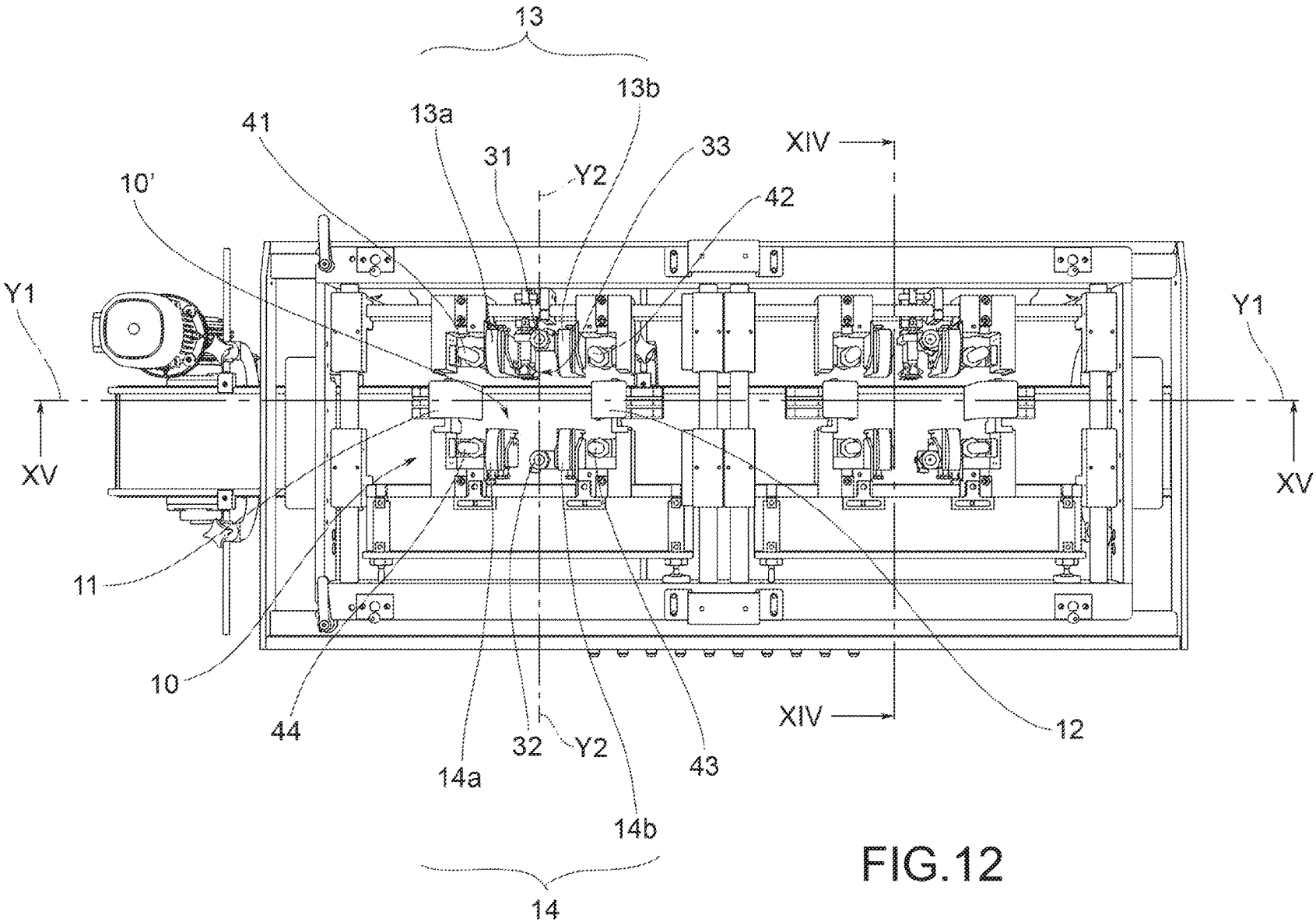
FIG. 12 shows a plan view from above of a detail of the apparatus illustrated in FIGS. 2 to 11, relating to the forming matrix.

According to a first aspect of the present invention, the forming apparatus 1 comprises at least two main vacuum gripping devices 31 and 32, which are arranged outside the forming cavity 10' in opposite positions along the aforesaid second axis Y2, as illustrated in detail in FIG. 12.

Operationally, each of these two main vacuum gripping devices 31 and 32 can be actuated to engage in gripping from underneath one of the two side walls F2 or F3 of the die-cut sheet F, when such a sheet (F) lies on the support plane m, in order to keep the side wall F2 or F3 substantially distended on the support plane m.

According to another aspect of the present invention, the forming apparatus 1 comprises at least four pusher devices 41, 42, 43 and 44, which are arranged externally to the aforesaid forming cavity 10'.

More in detail, as shown in FIG. 12, each of these pushers 41, 42, 43 and 44 is arranged near one of the four corners of the cavity.

Figure 9:
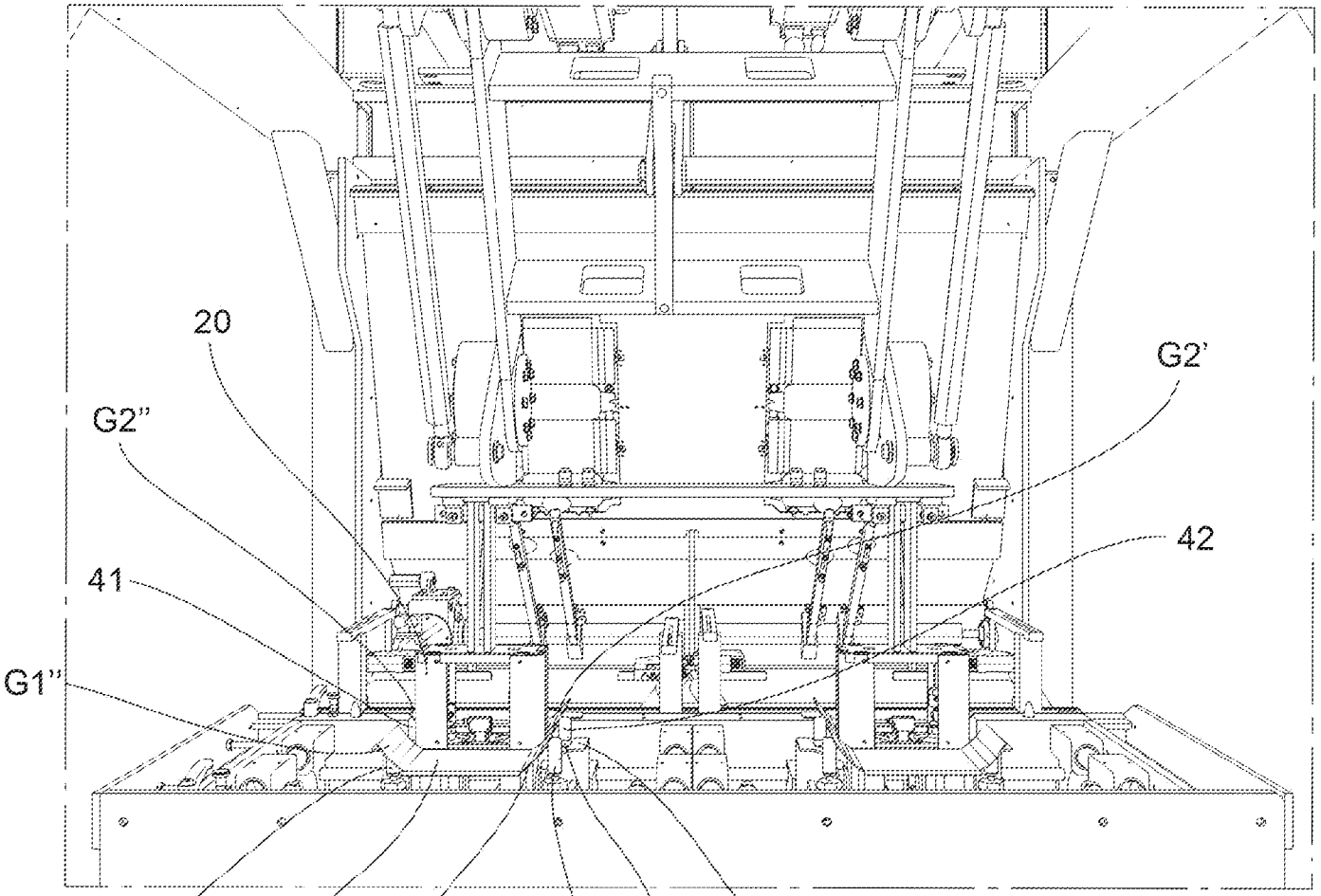
Figure 10:
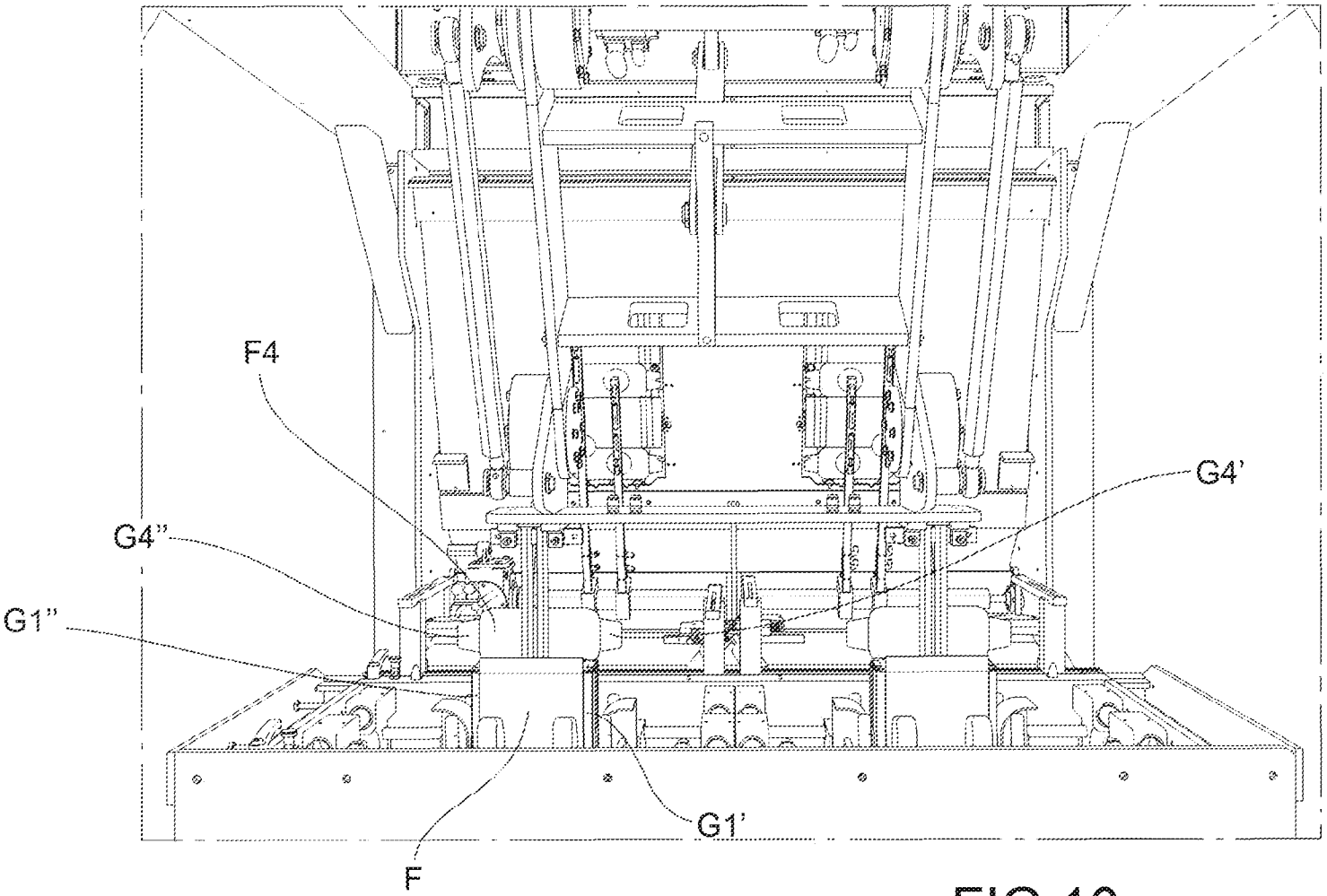
Figure 11:
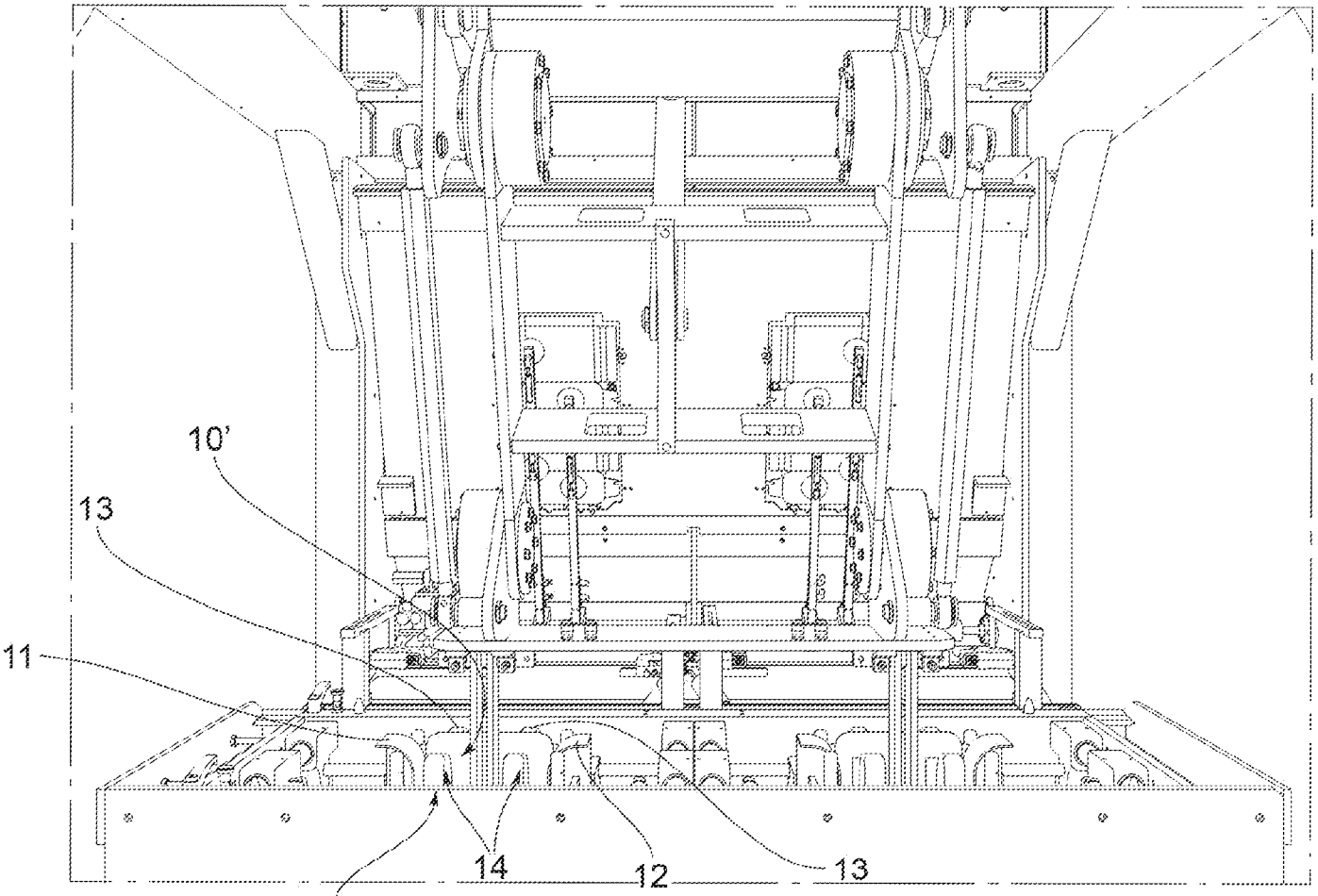
Figure 18:
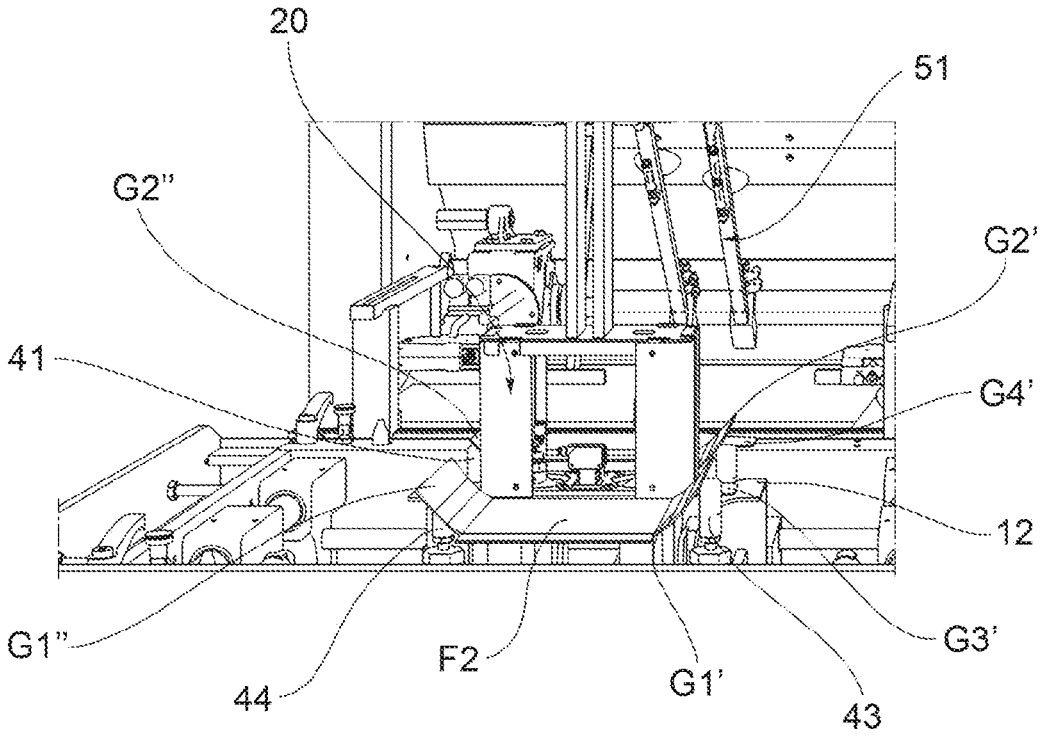

Operationally, as shown in particular in FIGS. 9 and 18, each of these pusher devices 41, 42, 43 and 44 is operable to lift one of the aforementioned four side flaps G1', G1" and G2', G2" of the die-cut sheet F from the support plane m, when this sheet F lies on the support plane m.

According to the invention, the forming apparatus 1 comprises an electronic control unit 100 that is programmed to operate at each forming cycle of a box B the main vacuum gripping devices 31 and 32, the pusher devices 41, 42, 43 and 44 and the forming head 20 according to the following sequence:

- gripping actuation of the vacuum gripping devices 31 and 32;
- actuation of the pushers 41, 42, 43 and 44;
- deactivation of the vacuum gripping devices 31 and 32 (so as to leave the walls F2 and F3 free); and
- insertion of the forming head 20 into the forming cavity.

This sequence of steps is illustrated in FIGS. 2 to 11.

As will be resumed hereinafter describing the forming method according to the invention, before inserting the forming head 20 inside the forming cavity 10', the forming apparatus 1 according to the invention allows preparing already raised the four side flaps G1', G1" and G2', G2" of the die-cut sheet F while retaining the two side walls F2 and F3 substantially extended on the support plane m.

In this way, during the subsequent forming (insertion of the forming head 20 inside the forming cavity 10'), the folding of the four side flaps G1', G1" and G2', G2" is anticipated with respect to the folding of the two fastening tabs G3', G3" and the latter are arranged externally in the finished box B.

In fact, when during the forming also the two fastening tabs G3', G3" start to fold inwards, the four side flaps G1', G1" and G2', G2" have already begun their positioning in advance with respect to tabs, thus arranging behind the tabs themselves, i.e. in the desired position.

Thanks to the invention, it is controlled effectively and safely the correct reciprocal positioning of the four side flaps G1', G1" and G2', G2" with respect to the two fastening tabs G3', G3" which extend from the base F1 of the box.

The forming apparatus 1 according to the invention therefore combines the high quality of construction permitted by the wrap-around technology with the simplicity and operating speed of the presser forming machines. The preparation step of the flaps in the raised position can be carried out very quickly, without actually slowing down the operation of the forming apparatus and, in particular, without requiring (as in the case of wrap-around technology) the positioning of the product and the folding of a portion at a time of the die-cut sheet.

Advantageously, as shown in FIGS. 2 to 8, the above electronic unit 100 is programmed so that at the beginning of each new forming cycle it deactivates the pusher devices 41, 42, 43, 44 so that they do not lift the four side flaps G1', G1" and G2', G2" of the die-cut sheet F from the support plane m, thus disturbing the positioning of the other portions of the sheet itself.

According to the embodiment illustrated in the accompanying Figures, and in particular in FIG. 15, each of the above pusher devices 41, 42, 43, 44 consists of a rod 40, which is movable by means of an actuator 41 between a passive position, in which it does not protrude beyond the above support plane m, and an active position, in which it protrudes beyond the above support plane m.

Operationally, the rod 41 simply pushes against the relative side flap G1', G1", G2' or G2" without however gripping it. In this way, when forming starts the side flaps are not retained by the pusher device and can follow the folding movements induced by the head and by the forming matrix. This is advantageous in terms of operating speed and simplicity of control since a specific step of disengagement of the pusher device from the side flap is not required.

Advantageously, the above rod 40 has an extension axis substantially orthogonal to the support plane m and moves between the above passive position and the above active position with an axial movement along its extension axis.

Preferably, the actuator 41 consists of a pneumatic cylinder.

Figure 14:
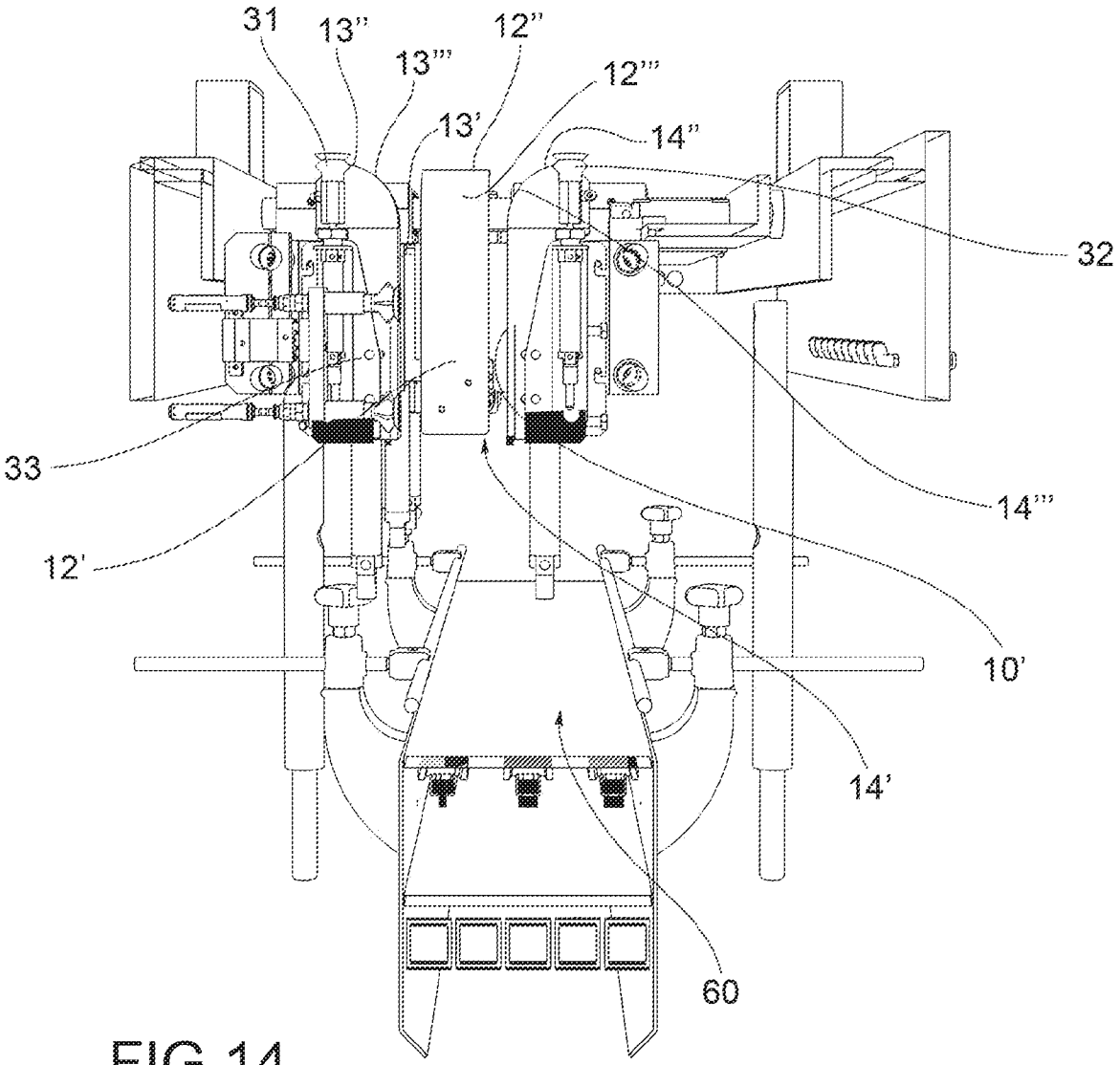
FIG. 14 shows a sectional (slightly perspective) view of the forming matrix shown in FIG. 12, according to the section plane XIV-XIV indicated therein.

Advantageously, as shown in FIGS. 14 and 15, each guide 11, 12, 13, 14 comprises:

- a first surface portion 11', 12', 13', 14', which defines at least a part of an inner wall of the forming cavity 10', and
- a second surface portion 11", 12", 13", 14", which defines a portion of the support plane m.

Advantageously, the above first surface portion 11', 12', 13', 14' and the above second surface portion 11", 12", 13", 14" are substantially orthogonal to each other and are connected to each other by a connecting surface portion 11'", 12'", 13'", 14'", which is preferably curved. Operationally, this allows a softer and more uniform folding of the die-cut sheet F.

According to the embodiment shown in the accompanying Figures, the two guides 13, 14 opposite along the second axis Y2 of the forming cavity 10' are each constituted by two distinct guide portions 13*a*, 13*b* and 14*a*, 14*b*, spaced parallel to the above first axis Y1 of the forming cavity 10'.

Advantageously, each of the above two main vacuum gripping devices 31, 32 is arranged between the two guide portions 13*a*, 13*b*; 14*a*, 14*b* of one of the two guides 13, 14 which are opposite along the second axis Y2 of the forming cavity 10'.

Preferably, each of the aforementioned two main vacuum gripping devices 31 and 32 comprises a suction cup and is provided with means for moving the suction cup orthogonally to the support plane m. In this way, it is possible to adjust the position of the suction cup with respect to the support plane m so as to bring it closer to the die-cut sheet F when it is necessary to carry out the gripping action thereon, and in such a way as to move it away from the sheet F, when it could disturb the positioning thereof on the support plane m.

Advantageously, as illustrated in the accompanying Figures, the forming apparatus 1 may comprise at least one secondary vacuum gripping device 33, which faces inside the forming cavity 10' to act as a grip on the box B after forming. The gripping action on the formed box B is functional to facilitate the extraction of the gripping head 20 from the forming cavity 10', avoiding the risk that the head 20 coming out of the cavity drags the box B therewith.

Preferably, the above secondary vacuum gripping device 33 comprises at least one suction cup and is provided with means for moving the suction cup orthogonally to the first surface portion 11', 12', 13', 14' of one of the above guides 11, 12, 13, 14. In this way, it is possible to adjust the position of the suction cup with respect to the wall of the forming cavity so as to bring it closer to the box B when it is necessary to carry out the gripping action thereon, and in such a way as to move it away from the box B during the forming, when it could disturb the formation thereof.

Figure 13:
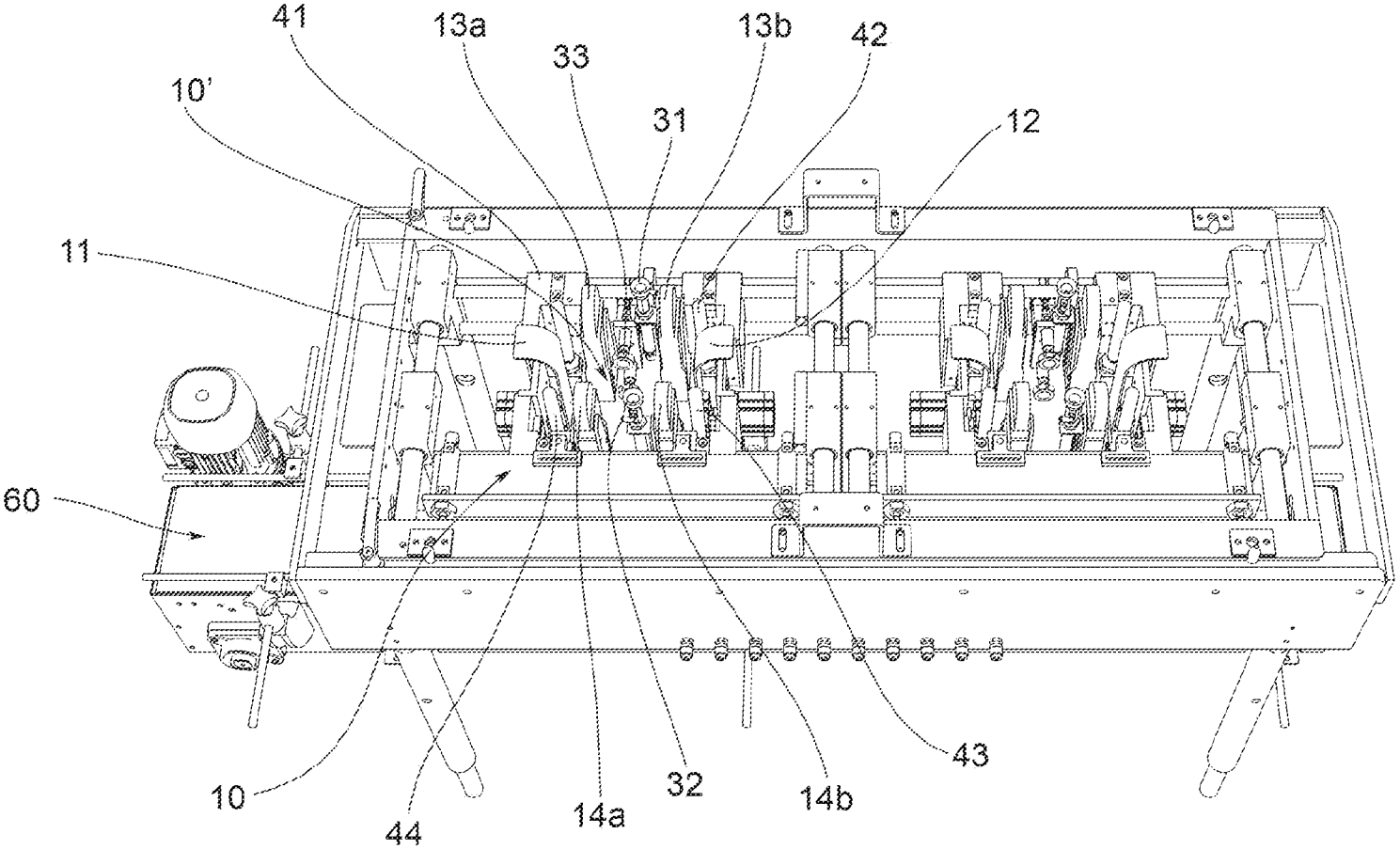
FIG. 13 shows top view of the forming matrix.

Preferably, as shown in the accompanying Figures, and in particular in FIGS. 13 and 14, the above secondary vacuum gripping device 33 is arranged between the two guide portions 13*a*, 13*b* or 14*a*, 14*b* of one of the two guides 13 and 14 which are opposite along the second axis Y2 of the forming cavity 10'. This allows optimizing the spaces and the structure of the forming apparatus 1.

Preferably, as illustrated in FIGS. 2 to 11, the forming apparatus 1 comprises at least one loader 50 of die-cut sheets and a transfer system 51, 52 of a die-cut sheet F from the aforesaid loader 50 to the aforesaid forming matrix 10.

According to the embodiment illustrated in the accompanying Figures, the aforementioned transfer system comprises:

- a first transfer device 51 which is suitable to take one die-cut sheet F at a time from the loader 50 to arrange it in an intermediate position between the loader 50 and the forming matrix 10; and
- a second transfer device 52 which is suitable to take a die-cut sheet F from the above first transfer device 51 in the intermediate position to transfer it above the forming matrix 10.

Preferably, the first transfer device 51 and the second transfer device 52 are each provided with one or more vacuum suction cups for gripping the die-cut sheet F.

Advantageously, the above second transfer device 52 is integrated in the forming head 20 and is movable with it.

Advantageously, the two pairs of guides 11, 12 and 13, 14 can be moved in relation to one another to vary the size of the forming cavity 10'. Operationally, this is functional both for extracting the forming head 20 from the cavity (in which case enlarging the cavity facilitates this operation), and for adapting the cavity to possible variations in the dimensions of the box to be formed.

Advantageously, also the forming head 20 is adjustable in its external dimensions, in order to adapt to the forming cavity 10'.

According to the embodiment illustrated in the accompanying Figures, and in particular in FIGS. 12 to 16, the apparatus 1 comprises a conveyor belt 60 placed below the forming die 10 for receiving the boxes B after forming in output from the bottom of the forming cavity 10'.

Advantageously, the forming apparatus 1 also comprises means (not shown in the accompanying figures) for depositing glue on the die-cut sheet F. Preferably, the deposition of the glue on predefined portions of the die-cut sheet F (preferably, the flaps and the tabs) occurs when the die-cut sheet F is completely extended on the support plane or when it is in the intermediate position between the loader 50 and the forming matrix 10.

Operationally, like the other components of the forming apparatus 1, the aforementioned glue deposition means are also controlled by the electronic control unit 100, according to a predefined control logic.

Advantageously, as illustrated in the accompanying Figures, the forming apparatus 1 may comprise two or more forming matrices 10, each provided with its own forming head, with its own sheet loader, etc., so that it is possible to simultaneously form two or more boxes B. This would not be possible in a wrap-around apparatus due to the mechanical complexity of the apparatus itself.

From the above description, it is apparent that the apparatus for forming boxes with curved corners starting from a die-cut sheet can be easily managed from an operational point of view.

More in detail, the complexity of the management of the apparatus 1 is comparable to that of a presser forming machine, and it is certainly lower than a wrap-around type apparatus.

From the above description, it is also apparent that the apparatus 1 for forming boxes with curved corners starting from a die-cut sheet according to the invention is simple and cost-effective to make compared to a wrap-around type apparatus.

Compared to a conventional forming machine, the forming apparatus 1 has some additional devices (in particular main gripping devices and pusher devices). However, the implementation and installation of such additional devices does not lead to an excessive increase in plant costs, since they are devices that are simple and inexpensive to make.

The method for forming boxes according to the invention will now be described.

The forming method according to the invention is intended to be implemented starting from die-cut sheets F having the same features as those described in relation to the forming apparatus 1. For the sake of description, the die-cut sheet F will not be described again, but reference should be made to the description already given in relation to the apparatus 1.

Similarly to what has already been said for the apparatus 1, the forming method according to the invention is suitable not only for forming boxes with curved corners, but also for boxes with sharp-edged corners.

More in detail, the method according to the invention comprises a first operating step a) of preparing a forming apparatus 1 comprising:

at least one forming matrix 10, which delimits a forming cavity 10' by means of two pairs of guides 11, 12 and 13, 14 counterposed in pairs along two orthogonal axes Y1 and Y2 of the cavity 10', such guides defining with their top a support plane m for the die-cut sheet F; and a forming head 20, which in use can be inserted inside the forming cavity 10' to push inside the cavity 10' the above die-cut sheet F lying on the support plane m, so as to form a box B by folding the die-cut sheet itself.

The method according to the invention comprises an operative step b) of positioning a die-cut sheet F resting on said support plane m in such a way that (see FIGS. 8 and 17):

the base F1 of the die-cut sheet F is arranged directly above the forming cavity 10' with its two fastening tabs G3', G3" positioned over a first pair of said guides 11, 12, the guides of such first pair being opposite each other along a first axis Y1 of the cavity; and the two side walls F2, F3 are arranged above the second pair of such guides 13, 14, the guides of such second pair being opposite along a second axis Y2 of such a cavity.

Preferably, step b) of positioning the sheet F takes place in an automated manner by means of special devices 51, 52 with which the forming apparatus 1 is provided.

After the positioning step b), the method according to the invention comprises an operative step c) of forming a box B by folding the die-cut sheet F, inserting the above forming head 20 inside the forming cavity 10' so as to push inside the cavity 10' the die-cut sheet F lying on the support plane m.

According to the invention, the forming method comprises an operative step d) of preparing the die-cut sheet F for forming.

This preparation step d) is carried out before the aforementioned forming step c) and after the positioning step of the die-cut sheet F.

In such a preparation step d), as shown in FIGS. 9 and 18, the four side flaps G1', G1" and G2', G2" of the die-cut sheet F are raised from the support plane m keeping the two side walls F2, F3 of such die-cut sheet F substantially distended on the support plane m, so that during the subsequent forming step c the folding of the four side flaps G1', G1" and G2', G2" is anticipated with respect to the folding of the two fastening tabs G3', G3" and the latter are arranged externally in the finished box B.

Advantageously, the preparation step d) is carried out in an automated manner by means of special gripping devices 31, 32 and special pusher devices 41-44 with which the forming apparatus 1 is provided, under the control of an electronic control unit 100 appropriately programmed.

Advantageously, the forming method comprises a glue deposition step e) on predefined portions of the die-cut sheet F (preferably, the flaps and the tabs)

Preferably, such a glue deposition step e) is carried out when the die-cut sheet F is completely distended on the support plane or when it is in an intermediate position between the loader 50 and the forming matrix 10.

Preferably, but not necessarily, the forming apparatus through which the forming method according to the invention is implemented, is the forming apparatus 1 according to the present invention, and in particular as described above.

Therefore, for the sake of description, the apparatus 1 by which the forming method can be implemented will not be described again, but reference should be made to the description already given above.

The advantages offered by the invention already highlighted above by describing the deposition apparatus 1 also apply to the deposition method and will not be repeated here for brevity of description.

The invention allows several advantages to be achieved, some of them already described.

The apparatus and the method for forming boxes with curved corners starting from a die-cut sheet allow effectively and safely controlling the correct reciprocal positioning of the four side flaps G1', G1" and G2', G2" with respect to the two fastening tabs G3', G3" which extend from the base F1 of the box.

The forming apparatus 1 and the forming method according to the invention therefore combine the high quality of construction permitted by the wrap-around technology with the simplicity and operating speed of the traditional presser forming machines. The preparation step of the flaps in the raised position can be carried out very quickly, without actually slowing down the operation of the forming apparatus and, in particular, without requiring (as in the case of wrap-around technology) the positioning of the product and the folding of a portion of the die-cut sheet F at a time.

The forming apparatus 1 according to the invention operates without prior positioning of the product. This simplifies the apparatus itself from a mechanical point of view, making the apparatus itself economically competitive for those who do not intend to purchase a forming line that is also able to position the product simultaneously with the shaping of the box.

The apparatus 1 for forming boxes with curved corners starting from a die-cut sheet can be easily managed from an operational point of view.

More in detail, the complexity of the management of the apparatus 1 is comparable to that of a traditional presser forming machine, and it is certainly lower than a wrap-around type apparatus.

The apparatus 1 for forming boxes with curved corners starting from a die-cut sheet according to the invention is simple and cost-effective to make compared to a wrap-around type apparatus.

Compared to a conventional forming machine, the forming apparatus 1 has some additional devices, in particular main gripping devices and pusher devices. However, the implementation and installation of such additional devices does not lead to an excessive increase in plant costs, since they are devices that are simple and inexpensive to make.

The forming apparatus and method according to the invention allow effecting an effective control of the mutual positioning of the side flaps and of the fastening tabs during the formation of the box. Advantageously, both the forming apparatus and the forming method 1 can also be used to form boxes with sharp-edged corners, in the case in which, similarly to the case of boxes with curved corners, it is necessary to ensure a precise and constant reciprocal positioning between the side flaps and the fastening tabs.

Advantageously, the forming apparatus 1 may comprise in parallel two or more forming lines (each provided with its own matrix, head, loader, etc.), so that it is possible to simultaneously form two or more boxes B. This would not be possible in a wrap-around apparatus due to the mechanical complexity of the apparatus itself.

The invention thus conceived thus achieves the intended purposes.

Of course, it may take, in its practical embodiment, also shapes and configurations other than the above without departing from the present scope of protection.

Furthermore, all details may be replaced with technically equivalent elements and dimensions, shapes and materials used may be any according to the needs.

The invention claimed is:

1. An apparatus for forming boxes with curved corners from a die-cut sheet, wherein said die-cut sheet comprises:

at least three main portions, which define respectively a base and two opposite front side walls of a single box and are connected to each other successively along a main axis of the die-cut sheet by pre-folding lines, with the two side walls connected in opposite positions to the base, and a top connected to one of the two side walls;

four side flaps, which define in pairs two head walls of said box and extend laterally from the two side walls; and at least two fastening tabs, which extend laterally from the base via pre-folding lines and overlap at least partially with the side flaps and connecting the side flaps in pairs;

said apparatus comprising:

at least one forming matrix, which delimits a forming cavity by two pairs of guides counterposed in pairs along two orthogonal axes of said cavity, said guides defining with a top of a support plane for said die-cut sheet;

a forming head, which in use is insertable inside said forming cavity to push said cavity said die-cut sheet lying on said support plane inside said cavity, to form a box by folding said die-cut sheet, said forming matrix being configured to receive said die-cut sheet resting on said support plane so that:

the base of said die-cut sheet is arranged directly above said forming cavity with the two fastening tabs positioned over a first pair of said guides, the guides of said first pair being opposite each other along a first axis of said cavity; and the two side walls are arranged above a second pair of said guides, the guides of said second pair being opposite along a second axis of said cavity, at least two main vacuum gripping devices, which are arranged externally to said cavity in opposite positions along said second axis and are each operable to engage in gripping from underneath one of the two side walls of said die-cut sheet, when said sheet lies on said support plane, to keep the side wall substantially tight on said support plane; and at least four pusher devices, which are arranged externally to said cavity, each of the pusher devices being near one of the four corners of said cavity, wherein each of the pushers are operable to lift one of said four side flaps of said die-cut sheet from said support plane, when said sheet lies on said support plane, and an electronic control unit programmed to operate at each forming cycle of the box the main gripping devices, the pusher devices and the forming head according to the following sequence: gripping actuation of the gripping devices; actuation of the pushers; deactivation of the gripping devices; and insertion of the forming head in the forming cavity.

2. The apparatus according to claim 1, wherein said electronic unit is programmed so that at the beginning of each new forming cycle, the electronic unit deactivates the pusher devices so that the pusher devices do not lift the four side flaps of said die-cut sheet from said support plane.

3. The apparatus according to claim 1, wherein each of said pusher devices consists of a rod, which is movable by an actuator between a passive position, in which the rod does not protrude beyond said support plane, and an active position, in which the rod protrudes beyond said support plane.

4. The apparatus according to claim 3, wherein said rod has an extension axis substantially orthogonal to said support plane and moves between said passive position and said active position with an axial movement along the extension axis.

5. The apparatus according to claim 1, wherein each of the guides comprises a first surface portion, which defines at least a part of an inner wall of said forming cavity, and a second surface portion, which defines a portion of said support plane.

6. The apparatus according to claim 5, wherein said first surface portion and said second surface portion are substantially orthogonal to each other and are connected to each other by a connecting surface portion, which is curved.

7. The apparatus according to claim 1, wherein the two guides opposite along the second axis of the forming cavity each comprise two distinct guide portions, spaced parallel to said first axis of said forming cavity.

8. The apparatus according to claim 7, wherein each of said two main vacuum gripping devices is arranged between the two guide portions of one of the two guides which are opposite along the second axis of the forming cavity.

9. The apparatus according to claim 1, wherein each of said two main vacuum gripping devices comprises a suction cup and is equipped with a transport for moving said suction cup orthogonally to said support plane.

10. The apparatus according to claim 1, comprising at least one secondary vacuum gripping device, which faces inside said forming cavity to act as a grip on said box after forming.

11. The apparatus according to claim 10, wherein said secondary vacuum gripping device comprises at least one suction cup and is provided with a transport for moving said suction cup orthogonally to the first surface portion of one of said guides.

12. The apparatus according to claim 10, wherein said secondary vacuum gripping device is arranged between the two guide portions of one of the two guides which are opposite along the second axis of the forming cavity.

13. The apparatus according to claim 1, comprising at least one loader of a plurality of die-cut sheets and a transfer system of the plurality of die-cut sheets from said loader to said forming die.

14. The apparatus according to claim 13, wherein said transfer system comprises:

a first transfer device receiving one of the die-cut sheets at a time from said loader to arrange the one of the die-cut sheets in an intermediate position between said loader and said forming die; and a second transfer device receiving the one of the die-cut sheets from said first transfer device in said intermediate position to transfer said die-cut sheet above said forming die.

15. The apparatus according to claim 14, wherein the first transfer device and said second transfer device are each provided with one or more vacuum suction cups for gripping the die-cut sheet.

16. The apparatus according to claim 14, wherein said second transfer device is integrated in said forming head and is movable with said forming head.

17. The apparatus according to claim 1, wherein said pairs of guides are movable in relation to one another to vary the size of said forming cavity.

18. The apparatus according to claim 1, comprising a conveyor belt placed below the forming die.

19. The apparatus according to claim 1, comprising an applicator for depositing glue on the die-cut sheet.

20. A method for forming boxes with curved corners from a die-cut sheet, wherein said die-cut sheet comprises:

at least three main portions, which define respectively a base and two opposite front side walls of a single box and are connected to each other successively along a main axis of the die-cut sheet by pre-folding lines, with the two side walls connected in opposite positions to the base, and a top connected to one of the two side walls;

four side flaps, which define in pairs two head walls of said box and extend laterally from the two side walls; and at least two fastening tabs, which extend laterally from the base via pre-folding lines and overlap at least partially with the side flaps and connecting the side flaps in pairs;

said method comprising the following steps:

a) preparing a forming apparatus comprising: —at least one forming matrix, which delimits a forming cavity by two pairs of guides counterposed in pairs along two orthogonal axes of said cavity, said guides defining with a top of a support plane for said die-cut sheet; and —a forming head, which in use is insertable inside said forming cavity to push inside said cavity said die-cut sheet lying on said support plane, to form a box by folding said die-cut sheet, b) placing a die-cut sheet to rest on said support surface so that: —the base of said die-cut sheet is arranged directly above said forming cavity with the two fastening tabs positioned over a first pair of said guides, the guides of said first pair being opposite each other along a first axis of said cavity; and —the two side walls are arranged above a second pair of said guides, the guides of said second pair being opposite along a second axis of said cavity;

c) forming the box by folding said die-cut sheet, inserting said forming head inside said forming cavity to push inside said cavity said die-cut sheet lying on said support surface, d) preparing the die-cut sheet for forming, wherein said preparation step d) is carried out before said forming step c) and after the positioning step b) of the die-cut sheet and wherein in said preparation step d) the four side flaps of said die-cut sheet are raised from said support plane keeping the two side walls of said die-cut sheet substantially tight on said support plane, so that during the subsequent forming step (c) the folding of the four side flaps is anticipated with respect to the folding of the two fastening tabs and the two fastening tabs are arranged externally in the finished box.

21. The method according to claim 20, wherein said method is implemented by:

at least one forming matrix, which delimits a forming cavity by two pairs of guides counterposed in pairs along two orthogonal axes of said cavity, said guides defining with a top a support plane for said die-cut sheet;

a forming head, which in use is insertable inside said forming cavity to push said die-cut sheet lying on said support plane inside said cavity, to form a box by folding said die-cut sheet, said forming matrix being configured to receive said die-cut sheet resting on said support plane so that:

the base of said die-cut sheet is arranged directly above said forming cavity with the two fastening tabs positioned over a first pair of said guides, the guides of said first pair being opposite each other along a first axis of said cavity;

the two side walls are arranged above the second pair of said guides, the guides of said second pair being opposite along a second axis of said cavity;

at least two main vacuum gripping devices, which are arranged externally to said cavity in opposite positions along said second axis and are each operable to engage in gripping from underneath one of the two side walls of said die-cut sheet, when said sheet lies on said support plane, to keep the side wall substantially distended on said support plane;

at least four pusher devices, which are arranged externally to said cavity, each of the pusher devices being near one of the four corners of said cavity, wherein each of the pushers are operable to lift one of said four side flaps of said die-cut sheet from said support plane, when said sheet lies on said support plane; and an electronic control unit programmed to operate at each forming cycle of a box the main gripping devices, the pusher devices and the forming head according to the following sequence: gripping actuation of the gripping devices; actuation of the pushers; deactivation of the gripping devices; and insertion of the forming head in the forming cavity.

* * * * *